US006668147B2

(12) United States Patent
Ikeguchi

(10) Patent No.: US 6,668,147 B2
(45) Date of Patent: Dec. 23, 2003

(54) DEVELOPING DEVICE, IMAGE FORMING DEVICE AND PROCESS UNIT

(75) Inventor: Hiroshi Ikeguchi, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/214,560

(22) Filed: Aug. 9, 2002

(65) Prior Publication Data

US 2003/0039487 A1 Feb. 27, 2003

(30) Foreign Application Priority Data

Aug. 10, 2001 (JP) ..... 2001-243851

(51) Int. Cl.[7] ..... G03G 15/09
(52) U.S. Cl. ..... 399/277; 399/267
(58) Field of Search ..... 399/267, 277, 399/265, 276, 290; 430/122

(56) References Cited

U.S. PATENT DOCUMENTS 6,385,423 B1 * 5/2002 Kai ..... 399/277
6,449,452 B1 * 9/2002 Kai ..... 399/267
6,456,806 B2 * 9/2002 Shoji et al. ..... 399/277 X
2002/0009312 A1 * 1/2002 Sugimoto et al. ..... 399/277 X
2002/0028092 A1 * 3/2002 Ariizumi et al. ..... 399/267
2002/0094216 A1 * 7/2002 Sekine et al. ..... 399/267
2002/0141789 A1 * 10/2002 Terai ..... 399/267

FOREIGN PATENT DOCUMENTS

| | | |
|---|---|---|
| JP | 7-140730 | 6/1995 |
| JP | 2000-305360 | 11/2000 |
| JP | 2001-027849 | * 1/2001 |
| JP | 2001-109267 | 4/2001 |
| JP | 2001-324873 | * 11/2001 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

A developing device including a developer supporter, and a napping unit for napping the developer on the developer supporter by magnetic poles. The napping unit further includes a developing main magnetic pole installed at a location opposite to a latent image supporter, and a developing auxiliary magnetic pole located at a downstream side of the developing main magnetic pole in a rotational direction of the developer supporter. The developing main magnetic pole has a half-value width equal to or less than 22°. The composite magnetic flux density of the developing main magnetic pole and the developing auxiliary magnetic pole is equal to or greater than 80 mT. In this way, the disclosure can prevent voids in a back end from occurring to improve the fine line reproduction, and additionally, the carrier adhesion can be also prevented.

12 Claims, 6 Drawing Sheets

DEVELOPING DEVICE, IMAGE FORMING DEVICE AND PROCESS UNIT

CROSS-REFERENCE TO RELATED APPLICATION

This application claims the priority benefit of Japanese application serial no. 2001-243851, filed on Aug. 10, 2001.

BACKGROUND OF THE INVENTION

1. Field of the Invention

This invention relates generally to an image forming device for a copy machine, a printer, a facsimile, or a multi-function machine having the above functions. More particularly, the invention relates to an image forming device for performing an image process by using a magnetic force, so that no "voids in the back end" occurs, the fine-line reproduction can be further improved, and the carrier adhesion can be further avoided.

2. Description of Related Art

In general in the image forming device using the electronic photography, such as the copy machine, the printer, or the facsimile, etc., an electrostatic latent image, which corresponds to an image information, is formed on a latent image supporter consisting of a photo-sensing drum or a photo-sensing belt, and a developing process is executed by a developing device to obtain a visualized image. Regarding the electrophotography, conventionally, a developing process, using a magnetic brush that makes the developer nap in a brush chain shape on the developer supporter, is well known In the above magnetic brush development, a good image concentration can be obtained if a distance between the latent image supporter and the developer supporter at a developing region is very close to each other. In addition, not much edge effect is known, but if too close, it is known that an image-quality degradation, the so-called "voids in a back end", will occur, i.e., white spots occur is the back end of a black solid image or a half-tone solid image.

In order to solve the above "voids in a back end" issue, the inventor has proposed a magnetic-brush developing device that narrows a nip portion (see Japanese Laid Open 2000-305360). According to the proposed developing device, in order to reduce the "voids in a back end", one of the methods to narrow the developing nip is to decrease a half-value width of a developing magnetic pole (below 22°). The half-value width is an angular width corresponding to a value that is half of the maximum normal magnetic force in magnetic force distribution curve along the normal direction of the developing magnetic pole. For example, if a maximum normal magnetic force of a magnet made of N-pole is 120 mT, the angle width corresponding to a value of 60 mT is the half-value width, which is also termed a peak 50% half-value width However, as the half-value width of the developing magnetic pole is reduced, it is understood that a carrier adhesion occurs easily. For example, if the half-value width is less than 20°, the carrier adhesion is very obvious.

SUMMARY OF THE INVENTION

According to the foregoing description, an object of this invention is to provide a developing device, an image forming device and a process unit, which can prevent voids in a back end from occurring to improve the fine line reproduction, and additionally, the carrier adhesion can be also prevented.

Accordingly, for achieving at least the above object(s), the invention provides a developing device. The developing device comprises at least a developer supporter for supporting a developer; a latent image supporter, opposite to the developer supporter, for supporting a latent image; and a napping unit. The napping device is used for napping the developer on the developer supporter by magnetic poles. The napping unit fiber comprises a developing main magnetic pole installed at a location opposite to the latent image supporter, and a developing auxiliary magnetic pole located at the downstream side of the developing main magnetic pole in the rotational direction of the developer supporter. In addition, the developing main magnetic pole has a half-value width equal to or less than 22°. The composite magnetic flux density of the developing main magnetic pole and the developing auxiliary magnetic pole is equal to or greater than 80 mT.

According to one aspect of the present invention, preferably, when the developer supporter is located opposite to the latent image supporter, with respect to the connection line of centers of the two supporters, the peak of the magnetic flux density in the normal direction of the developing main magnetic pole is deviated by 2°~10° towards an upstream side of the developer supporter in the rotational direction of the developer supporter. In addition, the developing auxiliary magnetic pole has a preferred half-value width equal to or greater than 35°. if the ratio of the half-value widths of the developing main magnetic pole and the developing auxiliary magnetic pole is 0.4~0.6 and the ratio of the peaks of the magnetic flux densities of the developing main magnetic pole and the developing auxiliary magnetic pole is 0.7~1.2, the developing device can be more effective.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

DESCRIPTION OF THE PREFERRED EMBODIMENT

Figure 1:
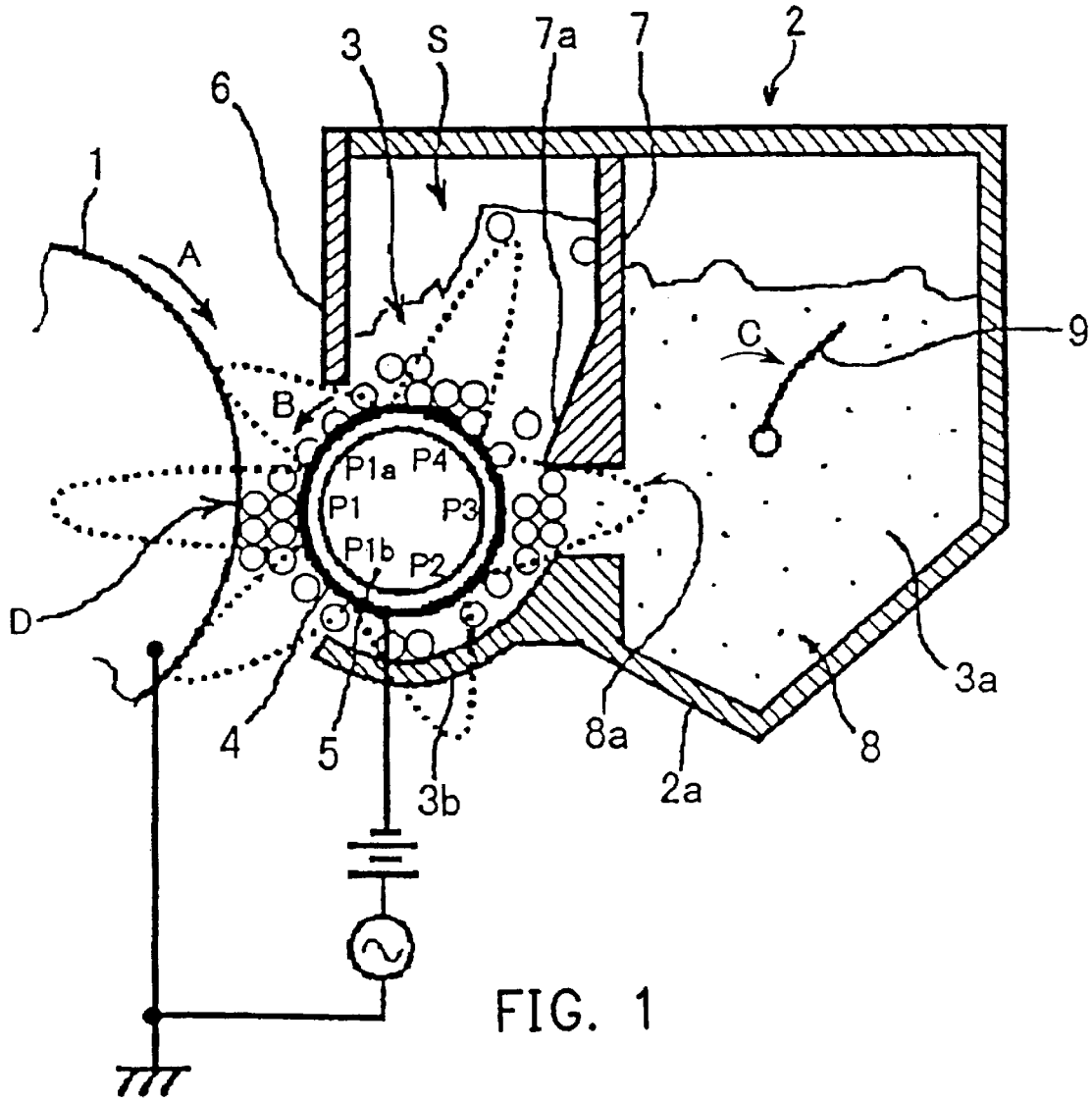
FIG. 1 shows a schematic structure of the developing device according to the embodiment of the invention.

The invention is described in detail based on the attached drawings. FIG. 1 shows a schematic structure of the developing device according to the embodiment of the invention. The developing device 2 is disposed at one side of a photo-sensing drum 1 (the right side with respect to the drawing), and has a developing sleeve 4 used as a developer supporter for carrying a two-component developer 3, which is composed of magnetic toner 3*a* and magnetic particles (magnetic supporters, hereinafter) 3*b* on the surface of the developing sleeve 4. The developing sleeve 4 is installed in a manner that a portion of the developing sleeve 4 is exposed to an opening formed in vicinity of the photo-sensing drum 1 on a casing 2*a*. By using a driving device (not shown), at a developing region facing the photosensing drum 1, the developer can be rotationally driven in a direction where the developer moves downwards (direction B in FIG. 1). In addition, a magnetic roller 5, which is composed of a stationary magnet group and serves as a magnetic field generator, is fixedly disposed inside the developing sleeve 4.

The developing device 2 further comprises a doctor blade 6, a developer containing case 7, and a toner hopper 8 used as a toner container, etc. The doctor blade 6 serves as a developer regulating unit for regulating an amount of the developer that is carried on the developing sleeve 4 and then transported towards the developing region D. The developer containing case 7 is arranged in such a manner to form a developer container S, for supplying the developer 3 from an upstream side of a developer transporting direction with respect to the doctor blade 6, to between the doctor blade 6 and the surface of the developing sleeve 4. The toner hopper 8 has a toner supply opening 8*a* located at an upstream side of a developer transporting direction with respect to the developer container S, and is opposite to the surface of the developing sleeve 4. In addition, a toner agitator 9 is further disposed within the toner hopper 8 and used as a toner stirring device, which is capable of rotating clockwise (arrow direction C, in FIG. 1) to stir and send out the magnetic toner 3*a* towards the toner supply opening 8*a*.

The front end (the visor portion) of the developer containing case 7 has a function of a pre-doctor blade 7*a* to sere as a second developer regulating Lit, so that the magnetic toner 3*a* is supplied from the toner hopper 8 and then moves into the interior of the developer container S. In addition, the developer 3, which is blocked by the doctor blade 6 from being supplied to the developing region D opposite to the photo-sensing drum 1, is stopped and retained inside the developer container S formed by the developer containing case 7 etc.

A plurality of magnets is arranged on the surface of the magnet roller 5, which are extended along the axial direction of the rotational center of the magnet roller 5 towards the radial direction. For example, a developing magnetic pole (main magnetic pole) P1 (N pole) is formed at a location opposite to the developing region D. In order to narrow an angle width of the half-value width of the magnetic flux distribution in the normal direction of the developing magnetic pole P1, auxiliary magnetic poles P1*a*, P1*b* having an opposite polarity (S pole) to the developing magnetic pole are disposed at locations where P1*a* and P1*b* are respectively near the upstream and the downstream sides of rotational direction of the developing sleeve 4 with respect to the developing magnetic pole P1. In addition, a magnetic pole P4 (N pole) is disposed between a location opposite to the pre-doctor blade 7*a* and the developing region D, so that the magnetic force created by the magnetic field can reach the developer container S. Furthermore, similar to the general developing device, transporting magnetic poles P2 (N pole), P3 (S pole) are arranged on the surface of the magnet roller 5 for supporting the developer on the developing sleeve 4 and transporting the developer. Moreover, the curves in dashed lines around the developing sleeve 4 shown in FIG. 1 are the distributions of the magnetic fluxes in the normal direction on the surface of the developing sleeve 4, which are formed by each magnetic pole and at the center of the axial direction of the developing sleeve 4.

There are six magnetic poles formed on the magnet roller 5, but additional magnetic poles can be further arranged between the auxiliary magnetic poles P1*a,* P1*b* to constitute a magnet roller having an octopole or a ten-pole structure. In addition, the developing magnetic pole P1 of the magnet roller S is made of a magnet whose cross-sectional area perpendicular to the rotational center axis is small. In general, if the cross-sectional area is small, the corresponding magnetic force is weak. If the magnetic force on the surface of the developing sleeve 4 is too small, a force for holding the magnetic carriers 3*b* is not sufficient, so that the magnetic carriers will be adhered onto the photo-sensing drum 1. In this embodiment, the magnet of the developing magnetic pole P1 is made of rare-earth metal alloy magnet which possesses a strong magnetic force. Typical examples among rare-earth metal alloy magnet are a iron-neodymium-boron alloy magnet whose num energy product is about 80 kJ/m3 and a iron-neodymium-boron alloy bond magnet whose maximum energy product of the is about 80 kJ/m3. In this way, in comparison with the conventionally used ferrite magnet and ferrite bond magnet (whose maximum energy products are about 36 $KJ/m^3$, 20 $kJ/m^3$ respectively), a strong magnetic force can be main ed. Even though a magnet with a small cross-sectional area is used, the magnetic force on surface of the developing sleeve 4 can be maintained. For maintaining the magnetic force, other cobalt-samarium metal alloy magnet can be also used.

Figure 2:
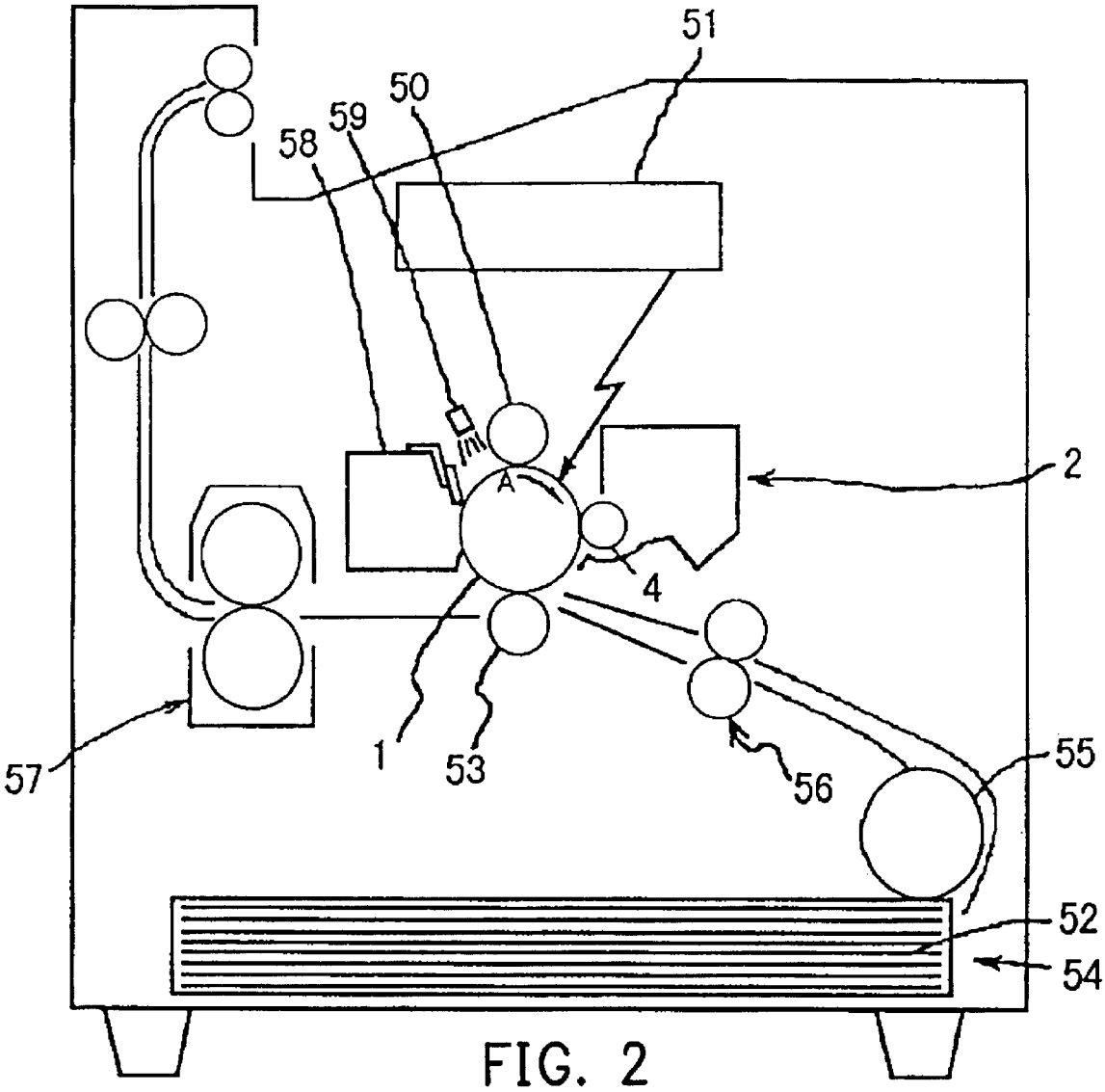
FIG. 2 is a schematic structure of an image forming device having the developing device in FIG. 1.

FIG. 2 shows a laser printer (printer, hereinafter) of electronic photography type using an image forming device equipped with a developing device 2 as described above. The photo-sensing drum 1, which is rotationally driven in the arrow A direction, is charged by a charging roller 50 that is in contact with the surface of the photo-sensing drum 1. The photo-sensing drum 1 is fiber scanned and exposed by an optical writing unit 51 based on image information, so as to form an electrostatic latent image on the surface of the photo-sensing drum 1. In this embodiment, the latent image forming device is constituted by the charging roller 50 and the optical writing unit 51, but other charging devices or expose devices can be also used to replace.

The electrostatic latent image formed on the surface of the photo-sensing drum 1 is developed by the developing roller 4 of the developing device 2 (also see FIG. 1 ), and then a toner image is formed on the surface of the photo-sensing drum 1. The toner image is transferred by a transfer unit (a transfer device) comprising a transfer roller 53 from a paper-feeding cassette 54, through a paper-feeding roller 55, a resist roller pair 56, to a transfer paper 52. The paper 52 after being transferred is ejected out of the printer after the toner image has been fixed by a fixing unit 57. The residual toner on the photo-sensing drum 1 without being transferred is removed by a cleaning unit 58, and the residual charges on the photo-sensing drum 1 are removed by a charge removing lamp 59.

In general, the image formation of the printer uses a 7.2 $\mu$m toner and 50 $\mu$m carriers, and the machine (printer) is operated under a condition that the ground potential $V_D$ is −900V, the potential of the image unit $V_L$ is −100V, and the developing bias $V_B$ is −700V. As for the toner concentration, the same result regarding the carrier adhesion can be obtained at a range of 4~20 mass %. In addition, it is understood that the image quality can be improved if an AC component is applied, but the carrier adhesion will occur. In contrast, in the present invention, even though an AC component is added to the printer, the carrier adhesion does not occur.

Figure 3:
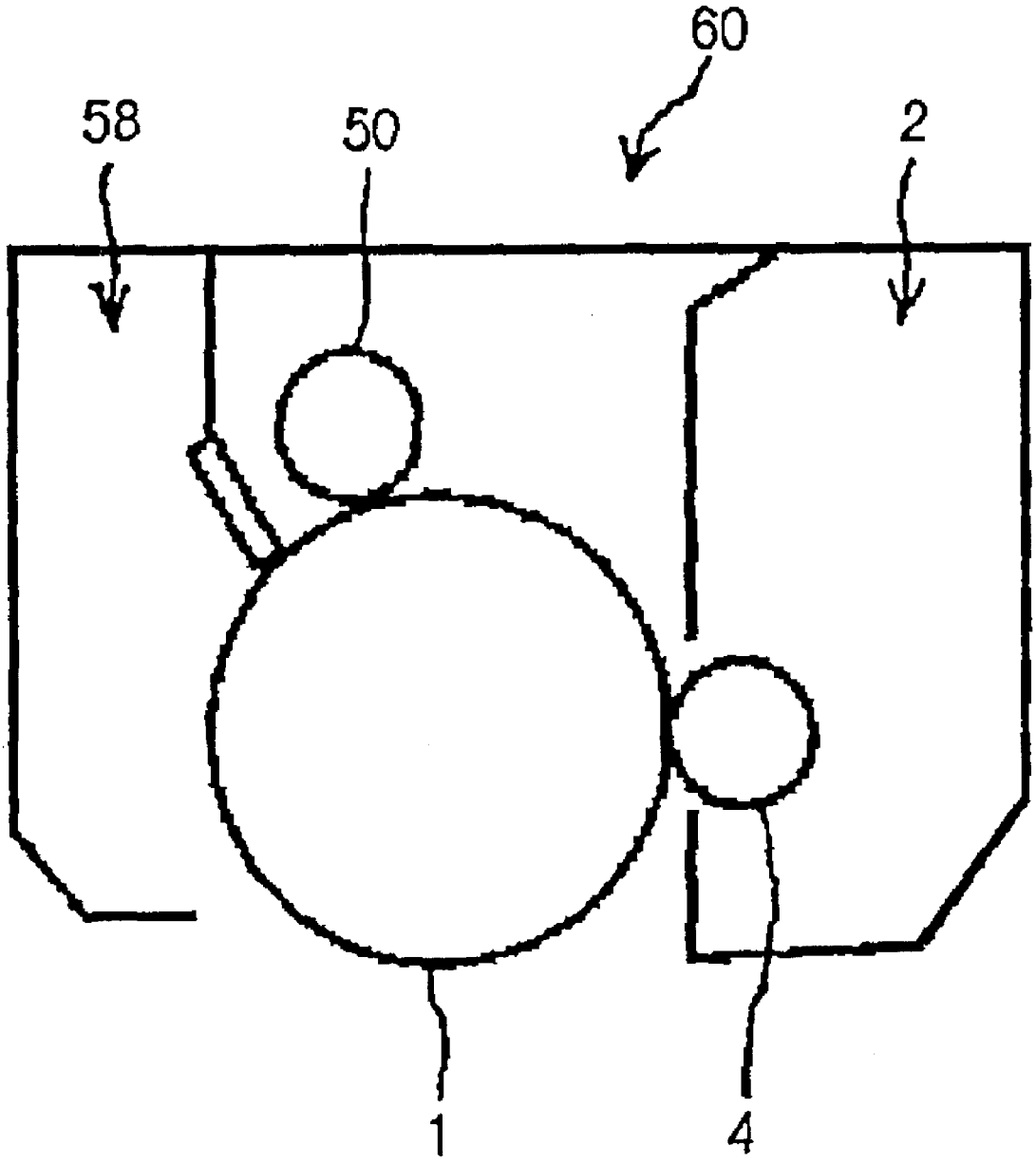
FIG. 3 is a conceptual diagram of a process unit having the developing device in FIG. 1.

FIG. 3 shows a process cartridge 60 used as an image formation process unit equipped with the developing device 2 as described above. The process cartridge 60 comprises a photo-sensing drum 1, a charging roller 50, a cleaning unit 58 and a developing device 2, all of which are integrated into the printer and detachable from the printer. The operation is as the same as the printer shown in FIG. 2 does, and has been described above. Therefore, its operation description is omitted.

Figure 4:
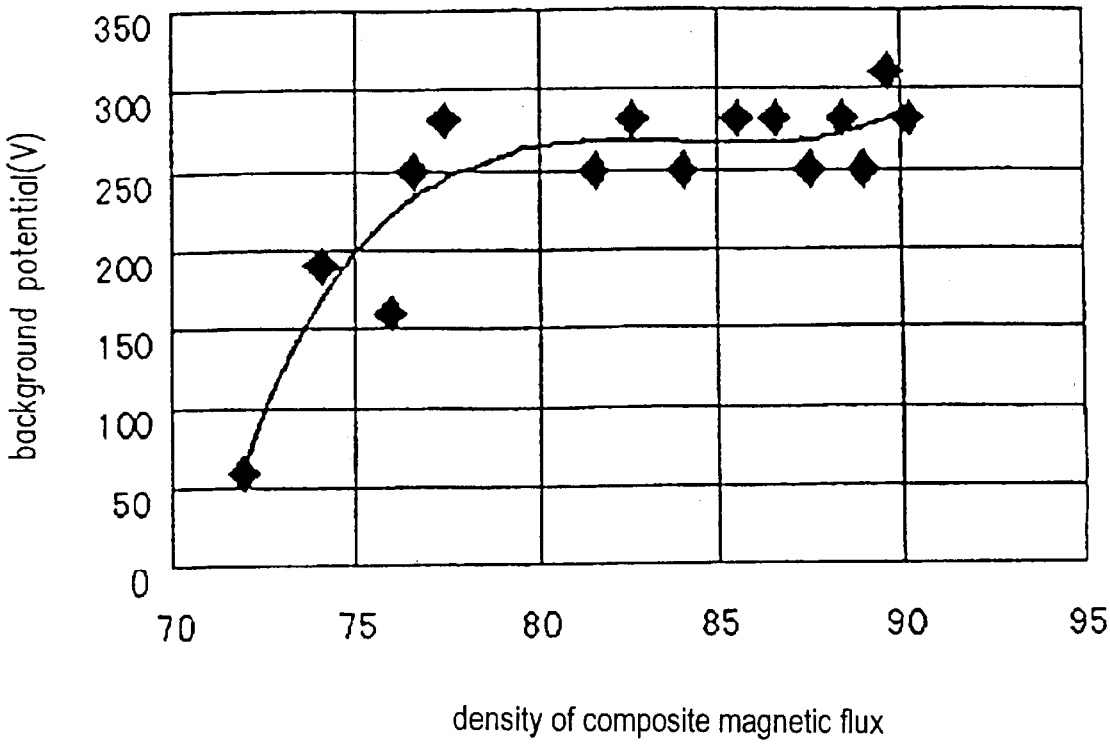
FIG. 4 is a graph showing a relationship between a main pole angle and a background potential that the carrier adhesion occurs.

Considering the carrier adhesion, the developing bias VB of the printer in FIG. 2 is varied, and additionally, the composite magnetic flux density of the developing main magnetic pole P1 and the auxiliary magnetic pole P1*b* (a composite value of each pole's magnetic flux density in normal direction and each pole's magnetic flux density in tangent direction) is varied, so as to obtain an evaluated result whether the carrier adhesion has appeared on an output image. FIG. 4 shows such evaluated result. The curve represents potentials that the carrier adhesion begins substantially. A deviation angle to an upstream side of peak of the magnetic flux density in the developing main pole's normal direction is 5°.

For a general image formation of the printer, a background potential ($|V_L-V_B|$) is 200V. No carrier adhesion at this level can be a condition for maintaining the image quality. However, under a low temperature and low humidity environment, it is known that the background potential at which the carrier adhesion occurs will increase. Therefore, theoretically no carrier adhesion occurs at a background potential of 250V should be a necessary condition for maintaining the image quality. From the result shown in FIG. 4, the carrier adhesion can fail to occur when the composite magnetic flux density is above 80 mT. In addition, because the carrier adhesion appeared on the output image usually occurs at the lowest region of the developing region (near the exit of the nip portion), therefore the influence of the magnetic pole P1*a* at the upstream side is not considered. Assuming that the magnetic flux density of the magnetic pole P1*a* becomes weak, even though the carrier adhesion to the photo-sensing drum 1 occurs at the upstream side, the adhered carrier can be recycled by a magnetic brush located at the developing region. Therefore, the condition for the magnetic pole P1*a* is not necessary to be particularly considered.

Figure 5:
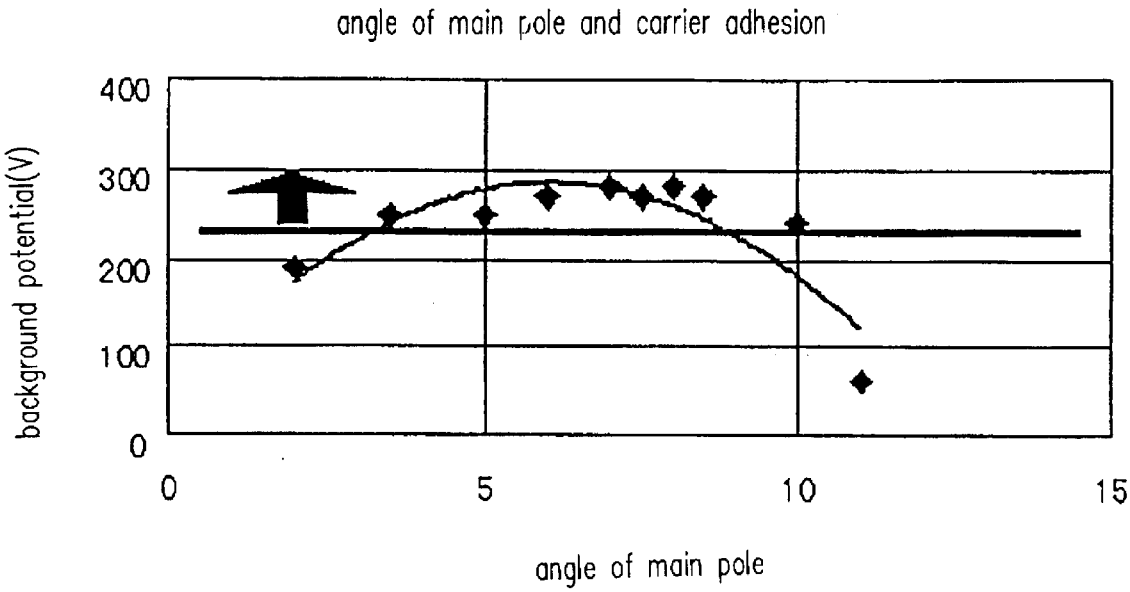
FIG. 5 is a graph showing a relationship between a composite magnetic flux density of a main magnetic pole and an auxiliary magnetic pole located at the downstream side of the main magnetic pole, and a background potential that the carrier adhesion occurs.

Next, when the peak of the magnetic flux density of the main magnetic pole P1 is shifted from a line connecting the centers of the photo-sensing drum 1 and the developing roller to the upstream side, the corresponding background potential at which the carrier adhesion occurs is shown in FIG. 5. The deviation angle is named as a man magnetic pole angle. From the result, it can be understood that the occurrence of the carrier adhesion can be effetely avoided by shifting the main magnetic pole angle by 2°~10° to the upstream side, and a deviation angle of about 3°~8° is preferable.

Figure 6:
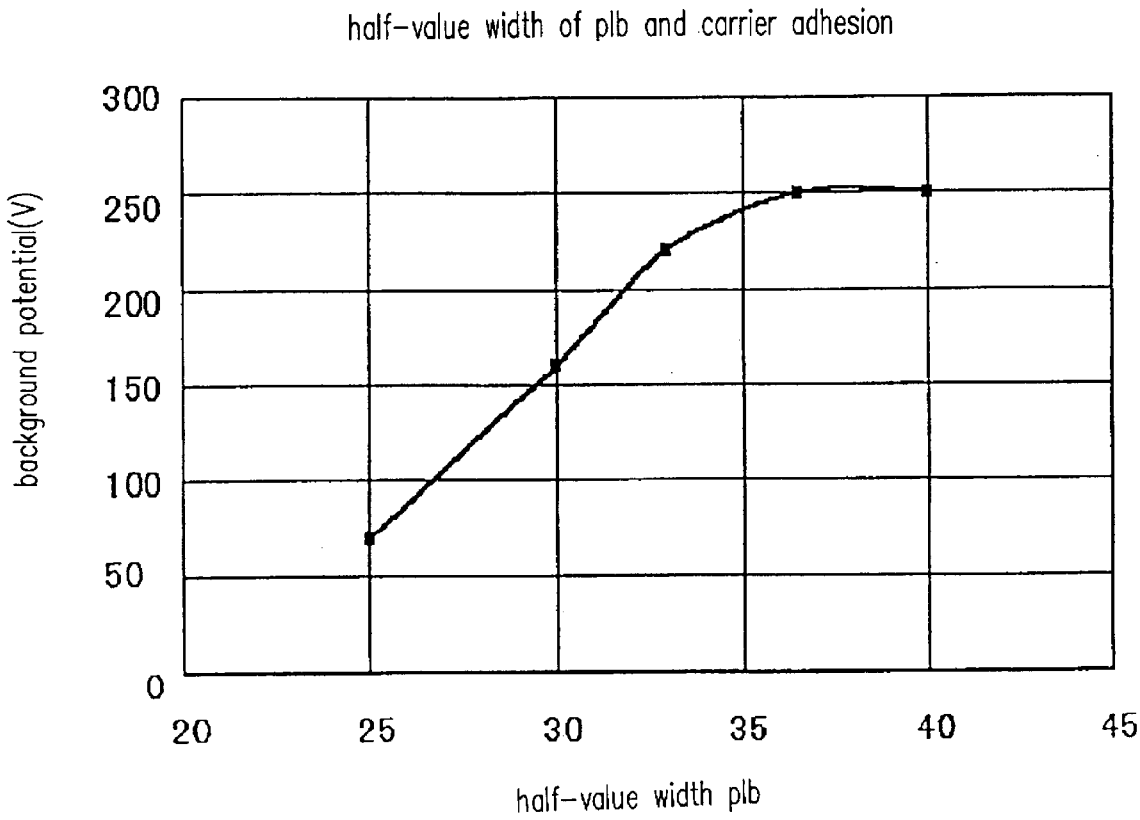
FIG. 6 is a graph showing a relationship between an auxiliary magnetic pole located at the downstream side of 20° half-value width of the main magnetic pole, and a background potential that the carrier adhesion occurs.

FIG. 6 shows a relationship between the half-value width of the auxiliary magnetic pole P1*b* located at the downstream side and the background potential at which the carrier adhesion occurs when the half-value width of the main magnetic pole P1 is 20°. This relationship can be also sustained even though the half-value width of the main magnetic pole P1 is 15° or 20°. As shown in FIG. 6, the carrier adhesion can be effectively prevented when the half-value width of the main magnetic pole P1 is above 35°.

Table II shows a relationship between the carrier adhesion and the ratio of the half-value width of the main magnetic pole P1 and the auxiliary magnetic pole P1*b*. In Table II, the toner concentration is 5% and the main magnetic pole angle is 5°. As shown, it can be understood that the occurrence of the carrier adhesion can be avoided when the ratio of the half-value width of P1/P1*b* is 0.4~0.6.

TABLE I

| Ratio of half-value width of P1/P1b | density of composite magnetic flux (mT) | carrier adhesion | background potential of carrier adhesion |
|---|---|---|---|
| 0.38 | 75 | No | 190 |
| 0.48 | 82 | Yes | 280 |
| 0.58 | 85 | Yes | 250 |
| 0.65 | 81 | No | 130 |
| 0.70 | 78 | No | 60 |

Table II shows a relationship between the carrier adhesion and the ratio of the peak magnetic flux density of the main magnetic pole P1 and the auxiliary magnetic pole P1*b*. In Table II, the toner concentration is 5%, the main magnetic pole angle is 5°, and the developing condition is the same as Table I. As shown, it can be understood that the occurrence of the carrier adhesion can be avoided when the ratio of the P1/P1*b* is 0.7~1.2.

TABLE II

| ratio of P1/P1b | density of composite magnetic flux (mT) | carrier adhesion |
|---|---|---|
| 0.6 | 75 | no |
| 0.7 | 82 | yes |
| 1.0 | 85 | yes |
| 1.2 | 81 | yes |
| 1.3 | 78 | no |

In summary, according to the invention, in the developing device whose half-value width of the developing magnetic pole is below 22°, the composite magnetic flux density of the developing main magnetic pole and the auxiliary magnetic pole is above 80 mT. In spite of the reduction of the half-value width of the developing magnetic pole, the magnetic carriers can be firmly attracted on the developer supporter, so that the carrier adhesion to the latent image supporter will not occur.

In addition, when the developer supporter is located opposite to the latent image supporter, with respect to a line connecting the centers of the developer supporter and the latent image supporter, a peak of a magnetic flux density in a normal direction of the developing main magnetic pole is deviated by 2°~10° towards an upstream side of the developer supporter in the rotational direction of the developer supporter. Therefore, the magnetic flux of the auxiliary magnetic pole at the developing region can be utilized for the carrier attraction, so as to suppress the carrier to move to the latent image supporter. By setting the half-value width of the auxiliary magnetic pole above 35°, increasing the tangent magnetic force of the developing main magnetic pole and the auxiliary magnetic pole, increasing the composite magnetic flux density, and only increasing the magnetic flux density of the developing main magnetic pole having a narrow half-value width, the image degradation can be avoided.

While the present invention has been described with a preferred embodiment, this description is not intended to limit our invention Various modifications of the embodiment will be apparent to those skilled in the art. It is therefore contemplated that the appended clams will cover any such modifications or embodiments as fall within the true scope of the invention.

What claimed is:

1. A developing device, comprising at least:

a developer supporter for supporting a developer;

a latent image supporter, opposite to the developer supporter, for supporting a latent image; and a napping unit for napping the developer on the developer supporter by magnetic poles, wherein the napping unit further comprises a developing main magnetic pole installed at a location opposite to the latent image supporter, and a developing auxiliary magnetic pole located at a downstream side of the developing main magnetic pole in a rotational direction of the developer supporter, and the developing main magnetic pole has a half-value width equal to or less than 22° and a composite magnetic flux density of the developing main magnetic pole and the developing auxiliary magnetic pole is equal to or greater than 80 mT, and wherein a ratio of the peaks of the magnetic flux densities of the developing main magnetic pole and the developing auxiliary magnetic pole is from about 0.7 to about 1.2.

2. The developing device of claim 1, wherein the developing auxiliary magnetic pole has a half-value width equal to or greater than 35°.

3. The developing device of claim 1, wherein a ratio of the half-value widths of the developing main magnetic pole and the developing auxiliary magnetic pole is from about 0.4~to about 0.6.

4. A developing device comprising at least:

a developer supporter for supporting a developer;

a latent image supporter, opposite to the developer supporter, for supporting a latent image; and a napping unit for napping the developer on the developer supporter by magnetic poles, wherein the napping unit further comprises a developing main magnetic pole installed at a location opposite to the latent image supporter, and a developing auxiliary magnetic pole located at a downstream side of the developing main magnetic pole in a rotational direction of the developer supporter, and the developing main magnetic pole has a half-value width equal to or less than 22° and a composite magnetic flux density of the developing main magnetic pole and the developing auxiliary magnetic pole is equal to or greater than 80 mT, and wherein when the developer supporter is located opposite to the latent image supporter, with respect to a line connecting the centers of the developer supporter and the latent image supporter, a peak of a magnetic flux density in a normal direction of the developing main magnetic pole is deviated by about 20°~to about 10° towards an upstream side of the developer supporter in the rotational direction of the developer supporter.

5. An image forming device, comprising at least:

a developing device, comprising:

a developer supporter for supporting a developer;

a latent image supporter, opposite to the developer supporter, for supporting a latent image; and a napping unit for napping the developer on the developer supporter by magnetic poles, wherein the napping unit further comprises a developing main magnetic pole installed at a location opposite to the latent image supporter, and a developing auxiliary magnetic pole located at a downstream side of the developing main magnetic pole in a rotational direction of the developer supporter, and the developing main magnetic pole has a half-value width equal to or less than 22° and a composite magnetic flux density of the developing main magnetic pole and the developing auxiliary magnetic pole is equal to or greater than 80 mT, and wherein a ratio of the peaks of the magnetic flux densities of the developing main magnetic pole and the developing auxiliary magnetic pole is from about 0.7 to about 1.2.

6. The image forming device of claim 5, wherein the developing auxiliary magnetic pole has a half-value width equal to or greater than 35°.

7. The image forming device of claim 5, wherein a ratio of the half-value widths of the developing main magnetic pole and the developing auxiliary magnetic pole is from about 0.4~to about 0.6.

8. An image forming device 6, comprising at least:

a developing device comprising:

a developer supporter for supporting a developer;

a latent image supporter, opposite to the developer supporter, for supporting a latent image; and a napping unit for napping the developer on the developer supporter by magnetic poles, wherein the napping unit further comprises a developing main magnetic pole installed at a location opposite to the latent image supporter, and a developing auxiliary magnetic pole located at a downstream side of the developing main magnetic pole in a rotational direction of the developer supporter, and the developing main magnetic pole has a half-value width equal to or less than 22° and a composite magnetic flux density of the developing main magnetic pole and the developing auxiliary magnetic pole is equal to or greater than 80 mT and wherein when the developer supporter is located opposite to the latent image supporter, with respect to a line connecting the centers of the developer supporter and the latent image supporter, a peak of a magnetic flux density in a normal direction of the developing main magnetic pole is deviated by about 2°~to about 10° towards an upstream side of the developer supporter in the rotational direction of the developer supporter.

9. A process unit, comprising at least:

a developing device, comprising:

a developer supporter for supporting a developer;

a latent image supporter, opposite to the developer supporter, for supporting a latent image; and a napping unit for napping the developer on the developer supporter by magnetic poles, wherein the napping unit further comprises a developing main magnetic pole installed at a location opposite to the latent image supporter, and a developing auxiliary magnetic pole located at a downstream side of the developing main magnetic pole in a rotational direction of the developer supporter, and the developing main magnetic pole has a half-value width equal to or less than 22° and a composite magnetic flux density of the developing main magnetic pole and the developing auxiliary magnetic pole is equal to or greater than 80 mT, and wherein a ratio of the peaks of the magnetic flux densities of the developing main magnetic pole and the developing auxiliary magnetic pole is from about 0.7 to about 1.2.

10. The process unit of claim 9, wherein the developing auxiliary magnetic pole has a half-value width equal to or greater than 35°.

11. The process unit of claim 9, wherein a ratio of the half-value widths of the developing main magnetic pole and the developing auxiliary magnetic pole is from about 0.4~to about 0.6.

12. A process unit comprising at least:

a developing device comprising:

a developer supporter for supporting a developer;

a latent image supporter, opposite to the developer supporter, for supporting a latent image; and a napping unit for napping the developer on the developer supporter by magnetic poles, wherein the napping unit further comprises a developing main magnetic pole installed at a location opposite to the latent image supporter, and a developing auxiliary magnetic pole located at a downstream side of the developing main magnetic pole in a rotational direction of the developer supporter, and the developing main magnetic pole has a half-value width equal to or less than 22° and a composite magnetic flux density of the developing main magnetic pole and the developing auxiliary magnetic pole is equal to or greater than 80 mT, and wherein when the developer supporter is located opposite to the latent image supporter, with respect to a line connecting the centers of the developer supporter and the latent image supporter, a peak of a magnetic flux density in a normal direction of the developing main magnetic pole is deviated by about 20°~to about 10° towards an upstream side of the developer supporter in the rotational direction of the developer supporter.

* * * * *